US006946044B2

(12) United States Patent
Lörsch

(10) Patent No.: US 6,946,044 B2
(45) Date of Patent: Sep. 20, 2005

(54) PREFABRICATED PLASTIC TUBE AND PROCESS FOR PRODUCING GAS-FILLED FILLING BODIES

(76) Inventor: Johannes Lörsch, An der Bleiche 49, D-47638 Straelen (DE)

( * ) Notice: Subject to any disclaimer, the term of this patent is extended or adjusted under 35 U.S.C. 154(b) by 0 days.

(21) Appl. No.: 10/315,715

(22) Filed: Dec. 10, 2002

(65) Prior Publication Data

US 2003/0138583 A1 Jul. 24, 2003

(30) Foreign Application Priority Data

Dec. 10, 2001 (DE) ..... 101 60 408

(51) Int. Cl.[7] ..... B65B 1/04
(52) U.S. Cl. ..... 156/147; 428/36.9; 428/43
(58) Field of Search ..... 156/147; 428/36.9, 428/43

(56) References Cited

U.S. PATENT DOCUMENTS 5,693,163 A * 12/1997 Hoover et al. ..... 156/147
6,213,167 B1 4/2001 Greenland

FOREIGN PATENT DOCUMENTS

| | | | | |
|---|---|---|---|---|
| DE | 19913408 A1 | 10/2000 | | |
| WO | WO97 46453 A1 | 12/1997 | | |
| WO | WO01 85434 A2 | 11/2001 | | |
| WO | WO 2003051742 A1 * | 6/2003 | ..... | B29D/23/00 |

* cited by examiner

*Primary Examiner*—Sandra Nolan Rayford
(74) *Attorney, Agent, or Firm*—Joan Pennington

(57) ABSTRACT

A plastic tube is prefabricated for producing gas-filled filling bodies. The tube comprises an upper film and a lower film which are connected together in superposed relationship along both of their longitudinal edges. The upper film is divided in its center by a longitudinal cut, thus forming upstanding flaps on both sides of the cut. The films are also subdivided into individual pockets by weld seams extending in the transverse direction of the tube at a spacing from each other. The tube can be filled by introducing a filling gas under the film flaps, the open ends of the pockets being closed after they have been inflated in that way.

2 Claims, 1 Drawing Sheet

PREFABRICATED PLASTIC TUBE AND PROCESS FOR PRODUCING GAS-FILLED FILLING BODIES

FIELD OF THE INVENTION

The invention concerns generally gas-filled filling bodies and more specifically a prefabricated plastic tube for the production of gas-filled filling bodies, a process for producing gas-filled filling bodies, and an apparatus for carrying out such a process.

In this specification the term film is used to denote any suitable flexible material of a film nature, irrespective of the thickness and constitution thereof provided that it is suited for the purposes of the invention.

DESCRIPTION OF THE RELATED ART

Gas-filled filling bodies are used for example for cushioning articles in transportation cases in order thereby to prevent the articles which are being transported from suffering from the effects of vibration or damage. The filling bodies are first filled with gas immediately prior to use thereof and can therefore be delivered to and stored at the packager or consumer in such a configuration as to save on a great deal of space. A further advantage of such filling bodies is that, because of their low weight, they scarcely increase the weight of the overall package and after use thereof they can be recycled without being separated into their respective constituents as they are usually made from a single plastic material.

In this respect reference may be made to DE 199 13 408 A1 disclosing a prefabricated plastic tube for the production of gas-filled filling bodies, in which an upper film and a lower film are welded together to form inflatable pockets in the transverse direction by mutually spaced pairs of gas-tight weld seams. The weld seams extend from a first longitudinal edge to a predetermined distance from the opposite second longitudinal edge. The pockets each have a gas filling opening between the upper and lower films, the filling opening being accessible from the second longitudinal edge. As the starting point for the production of a plastic tube of that nature is generally a full plastic tube, it firstly has to be divided in the longitudinal direction into two half-tube portions which are open at one side. That requires an additional working step before the actual operation for prefabrication of the plastic tube can be implemented. Furthermore, that plastic tube with its laterally arranged filling opening suffers from the problem that an asymmetry occurs when the air is blown thereinto, by virtue of the fact that the film inflates to form a filling cushion at the side remote from the filling opening, whereas in the region of the filling opening the film has to be kept flat in order to prevent air from escaping from the tube as it is being filled. That asymmetry results in difficulty in transporting the web of film material straight through the filling apparatus.

SUMMARY OF THE INVENTION

An object of the present invention is to provide a prefabricated plastic tube for the production of gas-filled filling bodies, the tube being of a simplified structure such as to make production thereof easier and more straightforward.

Another object of the present invention is to provide a process for producing gas-filled bodies from a prefabricated plastic tube, which involves a simplified operating procedure while nonetheless ensuring that the gas-filled filling body is of a satisfactorily reliable and durable nature.

Yet another object of the present invention is to provide an apparatus for carrying out the process for producing gas-filled filling bodies, which can be of a rational design configuration operable to carry out the process steps for producing the filling bodies in a simple sequence while affording reliable results.

In accordance with the principles of the present invention the foregoing and other objects are attained by the aspects of the invention as set forth herein.

Thus in accordance with the invention a plastic tube which is prefabricated for the production of gas-filled filling bodies has first and second films, which can be referred to as an upper film and a lower film, and which are arranged in mutually superposed relationship and are gas-tightly connected together at a first one of their longitudinal edges. The first film and the second film, for forming inflatable pockets, are welded together in the transverse direction by mutually spaced gas-tight weld seams. The first and second films are also connected together continuously at their second longitudinal edges. One of the films which in accordance with the foregoing definition can be referred to hereinafter as the upper film, has in its longitudinal direction a longitudinal cut extending at a spacing relative to the longitudinal edges.

Preferably the longitudinal cut extends centrally in relation to the width of the plastic tube. The longitudinal cut can be formed in the context of the procedure for prefabrication of the plastic tube or also only when the plastic tube has been introduced into the filling apparatus for filling gas-filled filling bodies produced from the tube.

Unlike the situation with the known prefabricated plastic tubes described hereinbefore, the plastic tube according to the invention is closed at both longitudinal edges and has a longitudinal cut at a spacing relative to the longitudinal edges. That difference has advantages in terms of manufacturing procedure as the starting point adopted for the production process is not a half-tube which firstly has to be cut out of a full tube in a separate working operation. On the contrary, it is possible directly to use a full tube which is in a condition of being laid flat, so that an entire film tube can be filled in one working operation. The output of a corresponding manufacturing plant can thus be virtually doubled as the procedure now involved does not require two half-tubes to be successively filled with gas. As will further be apparent from the description hereinafter of a preferred embodiment of the invention, another advantage of the plastic tube of the invention lies in a symmetrical filling operation, that is to say a filling operation which is less one-sided in the manner referred to hereinbefore, whereby the film is prevented from deviating from the proper transport direction as a consequence of an asymmetrical filling effect. Finally, as will be noted hereinafter, a further advantage of the plastic tube according to the invention is that there are pockets on both sides of the longitudinal cut so that the filling bodies formed therefrom are smaller than or for example half as large as filling bodies which extend over the entire width of the plastic tube from which they are produced. Narrower filling bodies of that kind permit a greater degree of flexibility to be achieved in terms of the use thereof as packaging material, while distribution in respect of height of the filling bodies is overall more uniform than when using wider filling bodies.

In accordance with a preferred feature of the invention the weld seams extending in the transverse direction are arranged in pairs, wherein an intermediate space is provided between the two weld seams of each pair, a perforation through the two films extending in the intermediate space in the transverse direction. Preferably that perforation extends continuously from one longitudinal edge of the plastic tube to the other. After the inflatable pockets have been filled with gas and after they have been gas-tightly welded shut, the perforation permits the filling bodies produced in that way to be separated from each other by being torn apart along the perforation.

Preferably, the weld seams extending in the transverse direction with respect to the plastic tube, either in pairs or individually, terminate at a given spacing from the longitudinal cut. That configuration provides that the first or upper foil is not connected to the second or lower foil in a strip around the longitudinal cut so that the edges of the first or upper foil, which are formed by the longitudinal cut, are movable flap-like over the entire length of the plastic tube and afford access, which can be satisfactorily sealed off, to the inflatable pockets.

In accordance with another preferred feature of the invention the second or lower foil has a perforation parallel to the longitudinal cut through the first or upper foil. After the operation of filling the pockets and welding them shut, the mutually oppositely disposed filling bodies can then be separated from each other in the longitudinal direction along the above-mentioned perforation.

If desired for example in connection with very wide plastic tubes, it is also possible to provide more than two mutually juxtaposed rows of pockets. In that case the upper film and/or the lower film have at least one further second longitudinal cut which extends at a spacing relative to the longitudinal edges of the films and relative to the first longitudinal cut. In that case the upper film and the lower film are welded together, preferably centrally, between each two longitudinal cuts, in the longitudinal direction of the tube, so that a fresh double row of pockets which are open at one end is formed between those longitudinal cuts.

In accordance with another preferred feature of the invention the plastic tube, in the region of the longitudinal cut, has markings which form codings to indicate the position of the weld seams and/or to indicate the film thickness and/or to indicate the film width. Such markings for the purposes of indicating the position of the weld seams avoid an expensive procedure, which would otherwise be required, for synchronising the apparatus for the production of filling bodies. The markings are preferably in the form of stamped-out openings but they could also be printed on in an equally preferred manner. In addition markings with coded information about the nature of the plastic tubes can be printed thereon or stamped out therein. In that way an apparatus for filling the plastic tubes according to the invention with gas can detect the nature of the film just being introduced into the apparatus, for example in terms of the film thickness, material and dimensions, and can thus automatically adapt various operating parameters such as for example the welding time and temperature, the filling gas amount or the filling time, the speed of transportation movement, the transportation distances involved, and so forth.

In a further preferred feature of the invention stamped-out openings are provided for the engagement of a bar for further transportation of the tube, wherein such openings may preferably be provided in the region of the transversely extending perforation and at least in the proximity of the longitudinal edges. In that way the plastic tube can be easily passed through a filling apparatus.

In another aspect of the invention the foregoing and other objects are also attained by a process for the production of gas-filled filling bodies, comprising the step of providing a prefabricated plastic tube according to the invention as set forth hereinbefore, injecting filling gas such as air into each pocket through a gas filling opening formed by the longitudinal cut in the first or upper film of the plastic tube, and then gas-tightly welding the gas filling opening of the now gas-filled pockets.

It will be seen from the description hereinafter of the preferred embodiment of the invention that the specific configuration of the plastic tube used in accordance with the invention permits such a process to be carried out in a highly advantageous manner. In particular the flap formed by the edges of the first or upper film along the longitudinal cut affords a good way of specifically injecting gas so that the pockets formed in the plastic tube can be fully filled. In addition the process has the advantage already referred to above, that the symmetrical effect of inflation and welding means that the plastic film no longer has a tendency to deviate out of its direction of transportation through the machine. Finally the filling bodies produced, being of half width, enjoy a number of advantages in terms of packaging procedures.

In accordance with the invention moreover in yet a further aspect of the invention the foregoing and other objects are attained by an apparatus for carrying out the above-depicted process for producing gas-filled bodies, comprising a holding means for a supply of tube and a transport means for transporting the tube through the apparatus. The apparatus may optionally have a device for forming the longitudinal cut in the tube if the prefabricated tube does not yet have such a cut. The apparatus further includes a gas filling means disposed in the region of the longitudinal cut in the first or upper film and a nozzle for introducing filling gas such as air into gas filling openings of the pockets for inflating same. A welding means is also arranged in the region of the longitudinal cut and includes a welding tool for gas-tightly closing the gas filling openings of the pockets with a weld seam which extends in the longitudinal direction of the tube.

It will be appreciated that such an apparatus also makes it possible to attain the above-discussed advantages enjoyed by the process of the invention. In this respect, in an advantageous feature of the apparatus, the gas filling means may have a filling shoe having first and second gas outlets facing in at least substantially mutually opposite directions, wherein the gas outlets can be introduced through the longitudinal slot in the first or upper film into the region between the films. Once such a filling shoe has been introduced into the region between the first and second films, it can be displaced in the direction of the longitudinal slot or cut and in so doing can successively fill the pockets with compressed gas such as air, by way of the lateral gas outlets thereof. It is advantageous in that respect that the second or lower film is closed throughout and does not afford any possible way for the gas to escape, and that at the same time the first or upper film bears against the filling shoe so that here also at most a minor amount of leakage is possible.

In order also to avoid the last-mentioned leakage at the first or upper film in a further preferred feature of the invention the gas filling means may have first and second hold-down means which, during the operation of introducing the gas, press the flaps of the first or upper film, which are formed by the longitudinal cut, against the filling shoe.

In accordance with a further preferred feature of the invention it has detection means for detecting markings on the plastic tube, operable to control the machine speed and/or the gas filling amount and/or the welding time. Thus by means of such detecting means it is possible to fill plastic tubes produced in various ways, in the apparatus, and such filling can be automatically adapted to the respectively optimum conditions.

In a preferred feature of the invention the transport means can be operable for cyclically transporting the tube through the apparatus. In other words the filling operation and the welding procedure each take place when the tube is stationary and the tube is then further transported by the length of a pocket.

It is particularly preferable however if the plastic tube is moved continuously past the gas filling means and the welding means. Such a mode of operation generally permits a greater production output, while the expenditure and complication in terms of control engineering can be kept down by possibly eliminating the cyclic control procedure.

Further objects, features and advantages of the invention will be apparent from the description hereinafter of a preferred embodiment.

BRIEF DESCRIPTION OF THE DRAWING

The present invention together with the above and other objects and advantages may best be understood from the following detailed description of the preferred embodiments of the invention illustrated in the drawing, wherein.

DETAILED DESCRIPTION OF THE PREFERRED EMBODIMENT

Referring generally to the Figures at this point shown in each thereof is a portion of a long plastic tube 1 which is prefabricated for ease of production of gas-filled packaging filling bodies.

Figure 1:
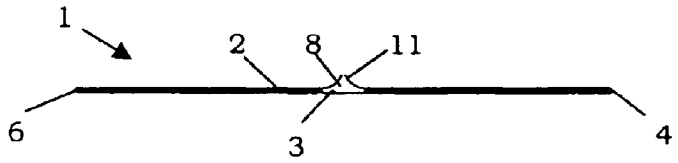
FIG. 1 shows a view in cross-section in a transverse direction through a plastic tube according to the invention taken along line I—I in FIG. 2.

Looking firstly at FIG. 1, reference numeral 1 therein denotes an elongate plastic tube 1 comprising first and second film webs which are disposed in mutually superposed relationship, thus forming an upper film indicated at 2 and a lower film indicated at 3. Typically that initial configuration is produced by a cylindrical full tube being laid flat with the upper and lower films 2 and 3 thus bearing flat against each other. The two longitudinal edges 4 and 6 of the plastic tube when in the laid-flat condition are thus connected together from the outset.

Figure 3:
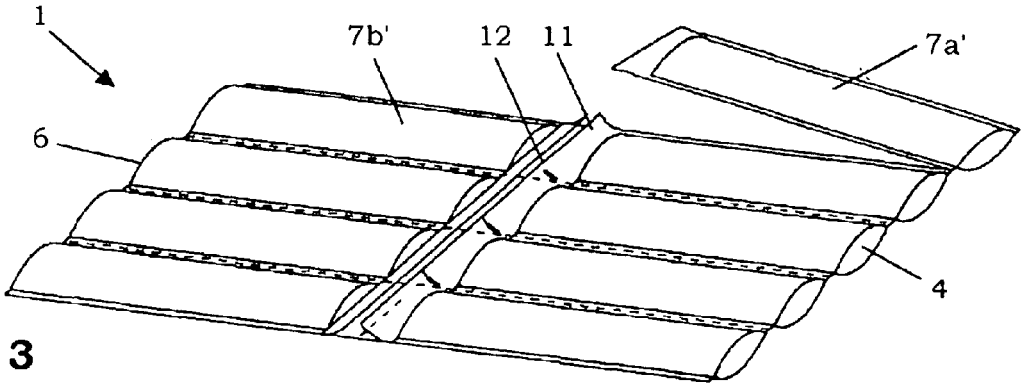
FIG. 3 shows a perspective view of the plastic tube according to the invention.

In addition the plastic tube 1 has pairs of weld seams 5 extending in a direction which is transverse with respect to the axial or elongation direction of the tube 1. The weld seams 5 connect the upper film 2 and the lower film 3 together and form between them inflatable pockets 7*a* and 7*b*. In that case each individual pair of weld seams 5 comprises two parallel, closely adjacent individual weld seams as indicated at 5*a* and 5*b*, between which there is a perforation 9 through the two films 2 and 3, the perforation 9 extending continuously from one longitudinal edge 4 to the other longitudinal edge 6. As can be seen from FIG. 3 the perforation 9 serves for easily tearing away an inflated filling body indicated in FIG. 3 at 7*a*′.

Figure 2:
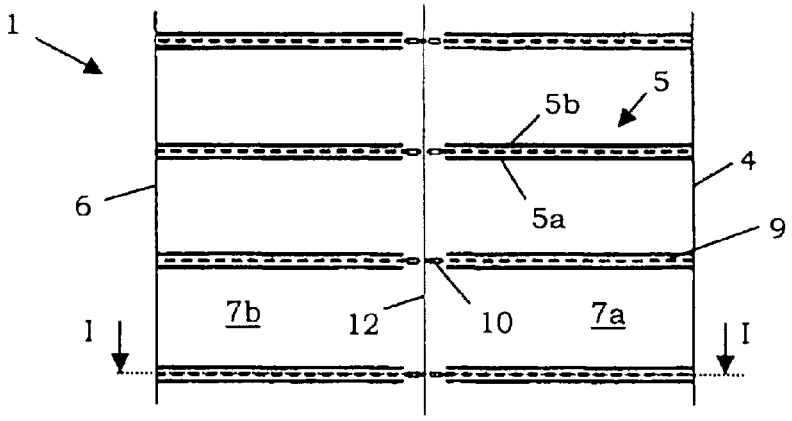
FIG. 2 is a plan view of a portion of the prefabricated plastic tube in accordance with the invention as shown in FIG. 1.

In addition it can be seen in particular from FIG. 2 that the pairs of weld seams 5 do not extend continuously from one edge of the tube to the other but are interrupted at the center along a strip. Also formed in that central strip is a longitudinal cut 12 through the upper film 2. The longitudinal cut 12 produces two edges on the upper film 2, those two edges forming movable flaps 11 which, by virtue of the above-indicated interruption in the weld seams 5*a*, 5*b*, are not connected to the lower film 3.

If the described plastic tube 1 is to be filled with gas such as air at the end consumer in order to produce inflated filling bodies as packaging bodies, the tube 1 is unwound from a storage roll and passed through an apparatus which is not shown in greater detail herein. If the prefabricated plastic tube 1 does not yet include a longitudinal cut as indicated at 12 in FIGS. 2 and 3, the cut 12 can be formed by a blade suitably provided in the apparatus. Subsequently a filling shoe, for example in the shape of an inverted T, is passed under the flaps 11 of the plastic tube 1. When that happens, two gas outlet openings which are oriented in opposite relationship in the transverse direction with respect to the tube 1 blow air or another suitable filling gas into each of the right-hand pocket 7*a* and the left-hand pocket 7*b* and thereby fill them. The gas is preferably introduced into the pockets 7*a* and 7*b* by way of a suitable blower. During this procedure the foil flaps 11 can be pressed down against the filling shoe by way of suitable hold-down devices in order to prevent the gas from escaping. In the transportation movement of the tube 1 the flaps 11 then slide over the filling shoe while the filling shoe blows gas such as air into the pockets 7*a*, 7*b* towards both sides.

The tube 1 can be transported through the apparatus by means of narrow wheels in the central region or by engagement into transportation perforations provided on the tube 1. Central engagement of the transportation forces has the advantage in this respect that the film is not tilted or distorted.

Directly after the operation of inflating the pockets 7*a*, 7*b* they are welded in the transport direction. In that case, in the embodiment of the plastic tube 1 shown in the Figures, two parallel weld seams are so disposed that they intersect the transversely extending weld seams 5*a*, 5*b* and thus in the final result provide for closed filling bodies 7*a*′, 7*b*′ which can be torn away.

Figure 4:
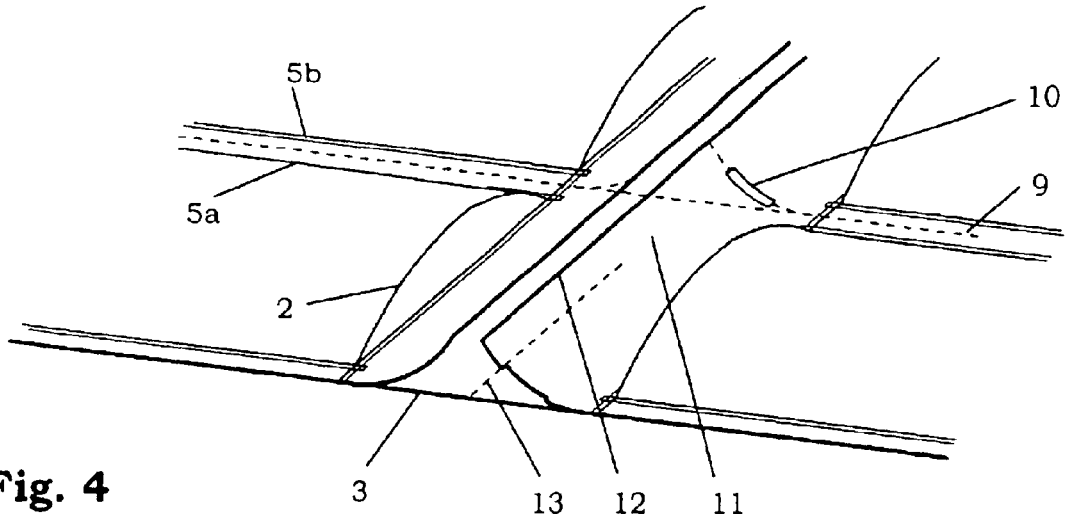
FIG. 4 shows a perspective view on an enlarged scale of the region of the plastic tube around the longitudinal cut thereof.

As can be seen also from FIGS. 2 and 4, markings can be provided in the film flaps 11 or also at other locations, in the form as illustrated of stamped-out openings 10 which can code the position of the transversely extending weld seams 5*a*, 5*b* or other items of information such as the film thickness or film width, as may be required for carrying out the production process.

It will be appreciated that the above-described embodiment of the invention has been set forth solely by way of example and illustration of the principles thereof and that various modifications and alterations may be made therein without thereby departing from the spirit and scope of the invention.

While the present invention has been described with reference to the details of the embodiment of the invention shown in the drawing, these details are not intended to limit the scope of the invention as claimed in the appended claims.

What is claimed is:

1. A process for producing gas-filled filling bodies comprising the steps of:

a) providing a prefabricated plastic tube comprising a first film having first and second longitudinal edges and a second film having first and second longitudinal edge and said first film and said second film are gas-tightly connected together in mutually superposed relationship at their longitudinal edges and are welded together to form inflatable pockets in a transverse direction by gas-tight weld seams arranged at a spacing relative to each other, said first film having a longitudinal cut in the longitudinal direction of the tube and extending at a spacing relative to the longitudinal edges, b) introducing a filling gas into each respective, opposed pocket through a respective gas filling opening under a respective flap formed by the longitudinal cut in said first film of said tube, simultaneously pressing down of said respective flaps to substantially flatten said respective flaps while introducing said filling gas to prevent filling gas from escaping, and c) gas-tight welding said respective flap of each said respective gas filling opening to said second film for closing of the gas-filled pockets.

2. A process as set forth in claim 1 wherein said filling gas is air.

* * * * *